United States Patent [19]

Fels

[11] 4,359,941

[45] Nov. 23, 1982

[54] CHUCKING MEANS FOR PRINTING FORM PLATES

[75] Inventor: Werner Fels, Kiel, Fed. Rep. of Germany

[73] Assignee: Dr. Ing. Rudolf Hell GmbH, Fed. Rep. of Germany

[21] Appl. No.: 208,435

[22] Filed: Nov. 19, 1980

[30] Foreign Application Priority Data

Nov. 19, 1979 [DE] Fed. Rep. of Germany ..... 2946597

[51] Int. Cl.[3] ..... B41F 27/12

[52] U.S. Cl. ..... 101/415.1

[58] Field of Search ..... 101/415.1

[56] References Cited

U.S. PATENT DOCUMENTS

| | | | |
|---|---|---|---|
| 2,553,856 | 5/1951 | Janke | 101/415.1 |
| 2,822,754 | 2/1958 | Huck | 101/415.1 |
| 3,976,005 | 8/1976 | Kaufmann | 101/415.1 X |
| 4,100,854 | 7/1978 | Fujishiro et al. | 101/415.1 |

FOREIGN PATENT DOCUMENTS

| | | | |
|---|---|---|---|
| 2116570 | 9/1971 | Fed. Rep. of Germany . | |
| 2744371 | 8/1979 | Fed. Rep. of Germany . | |
| 1278391 | 10/1961 | France | 101/415.1 |

*Primary Examiner*—Edgar S. Burr
*Assistant Examiner*—Charles Pearson
*Attorney, Agent, or Firm*—Hill, Van Santen, Steadman, Chiara & Simpson

[57] ABSTRACT

As a means of providing for a register-true chucking of printing plates to a plate cylinder for an offset printing press, the plate cylinder is provided with a seating surface for receiving thereon a forward edge of the printing plate and a series of chuck levers for clamping the plate against the seating surface. The chuck levers pivot about a common shaft extending axially with the cylinder and are driven by means of articulated link arrangements extending from a rotatable shaft parallel with the pivot shaft. The levers are divided into first and second types, the first type having a coupler linkage designed as a pressure spring and the second type having non-resilient linkage means such that the first group of levers engage the plate ahead of the second group. The levers are each formed with a clamp surface. The clamp surface of the levers and pressure surface on the cylinder are formed with grip means for locking the forward edge of the plate onto the pressure surface. The gripping means for the second type of levers comprises a stamping device for cutting and fitting sections of the printing plate into corresponding recesses formed in the pressure surface of the plate cylinder. The grip means for the first type of levers comprises corresponding pin and perforation devices.

10 Claims, 7 Drawing Figures

CHUCKING MEANS FOR PRINTING FORM PLATES

BACKGROUND OF THE INVENTION

1. Field of the Invention

The invention relates to a device for the precise or register-true chucking of form plates, particularly offset printing plates, onto plate cylinders of printing presses.

2. The Prior Art

In offset printing processes, such a multi-color offset printing, it is highly desirable to register the offset plates on the plate cylinders of the individual printing units in such a manner that no contour variations, sometimes called register errors, occur in the printing among the individual colors. Devices for adjusting the register axially of the cylinder and at right angles thereto are utilized in plate cylinder machines. Adjusting the register before printing begins, however, is time-consuming. With respect to proofing presses, there is a need to quickly print a specimen and then again release the machine, such that register time and printing time both need to be kept to a minimum. Known register adjustment means can usually only adjust the register in the two aforementioned directions. However if a register error occurs, such as may occur when plates are applied to the cylinder twisted in the manner of a helical line which may produce oppositely facing plate inclines between individual colors in a multi-color offset printing process, then correction by means of the register adjustment device is no longer possible. In order to produce a precise and faultless impression, the printing plates must be re-chucked which wastes a great deal of time. The situation is even more cumbersome when a so-called inner register error is produced as a result of the chucking device or faulty manipulation. Inner register error occurs when the printing plate has suffered deformations over such an area that register-true printing cannot occur. When such deformations are permanent, the plate is lost and must be recopied.

One type of known plate chucking device requires that the plate, prior to application to the plate cylinder, be rounded or specially pre-shaped in some manner at its contour edges by means of separate devices, such as disclosed in German AS 2744371 and German AS 2116570. Printing plate spacing devices require complex structure and their operation is prone to errors and is time-consuming. Furthermore, pre-shaping can rarely be executed with register precision. However, pre-shaping of plate edges is effective in orienting the plate in the chucking means of a plate cylinder. In some instances, alignment pins are formed on the cylinder and corresponding register perforations made in the plate to further ensure plate positioning on the cylinder; but these devices are merely redundant.

In another form of chucking means, printing plates are held by means of blocks positioned on the cylinder beneath clamping beams, such that a forward edge of the printing plate is frictionally held between the underside of a clamping beam and a corresponding flat surface of a block. Clamping pressure is typically produced by means of screws axially-spaced along the cylinder for correspondence with the clamping beams. The clamping beam may occur as a single element or a set of plural such devices and beams may be present for axial displacement of the clamping beam within certain limits in order to compensate for chucking errors. In some versions, register pins and plate perforations are also utilized for aiding in the alignment of the forward edge of the printing plate on the cylinder. However, due to the relative thinness of offset plates, the pin perforations can be stripped as printing pressures warp the plate. Accordingly, alignment produced with pins and perforations is imprecise and adjustment is time-consuming.

A drawback common to all plate chucking devices utilizing a clamping force is that the frictional force required for clamping a plate must be very great in order to counter tangential tension along the cylinder. In large-format presses, such tangential tension can range in the magnitude of 1,000 kg and, even if reduced by frictional resistance, is still a couple hundred kg at the clamping beam. When such forces are applied at the clamping beam, such as by screws, then one comes very close to that pressure which would damage or even destroy the plate. Torque-limiting tools for tightening clamping beam screws can only incompletely reduce the risk of damaging the plates in this manner. The conversion of torque into a pressing power greatly depends on the condition of screw threads, lubrication, etc. In practice, tolerances occurring in the screw means are usually greater than the narrow tolerance required for the requisite pressing power. Attempts have been made to increase the friction at the clamping beam by means of corresponding engagement surfaces in the beam and cylinder block, for example, interengaging undulating or triangular tooth-shaped ridges and grooves. However, this solution requires a greater surface area of the offset plate to be taken up in the chucking area, because of the permanent deformation such gripping arrangements necessitate. In addition, register observation or even a pre-alignment by the use of pins and perforations is not possible with adequate precision.

The present invention is drawn to a chucking device by which the aforementioned problems are reduced and which lends itself to short setup times. A chucking device which places the plate on the cylinder quickly and enables true register alignment independent of the skill of an operator is much needed in the art.

SUMMARY OF THE INVENTION

For precise register alignment of printing plates on a plate cylinder of a printing press, there is provided a chucking device which acts upon a forward surface of the printing plate. The chucking device comprises a plurality of levers disposed along a seating surface extending longitudinally of the cylinder. The levers are divided into first and second groups. The first group is formed by levers occurring at opposed ends of the row of levers and are movable via articulated lengths, one of which is resilient. The other group of levers are movable via non-resilient articulated lengths. The levers press the forward edge of the plate against a seating surface with sufficient pressure for absorbing tangential tensions of the printing plate and subsequent, chucking of the printing plate around the plate cylinder. In the chucking operation, the levers of the first type are applied before the levers of the second type take effect. The lever utilizes grip means for locking the plate against the seating surface in addition to a clamping force.

DESCRIPTION OF THE PREFERRED EMBODIMENTS

Figure 1:
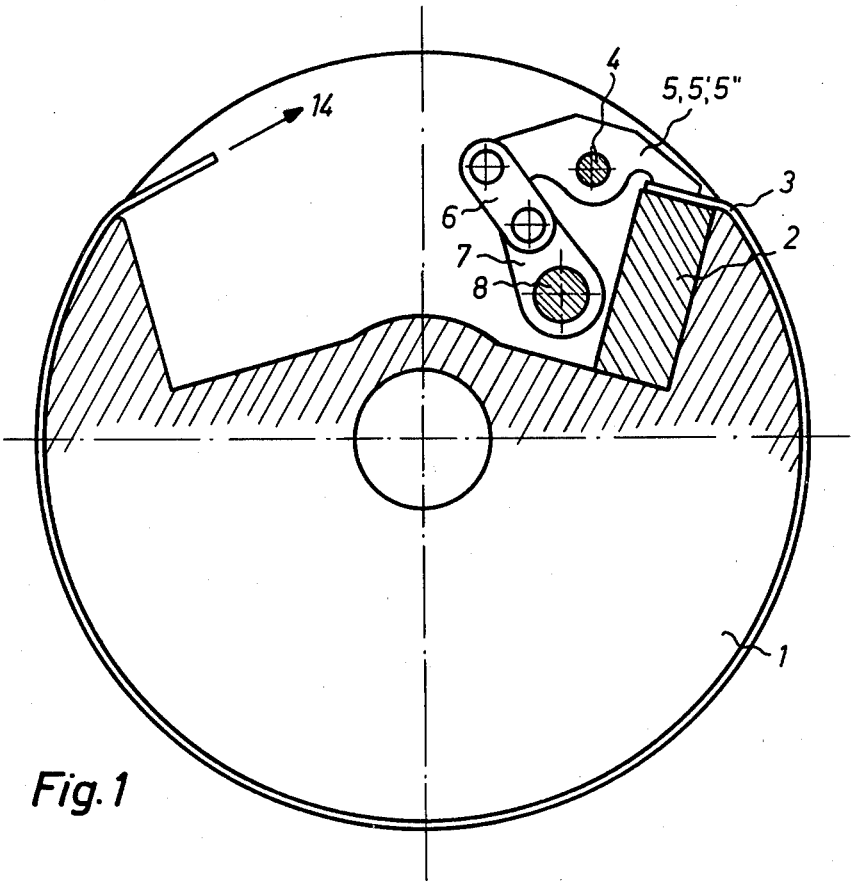
FIG. 1 is a schematic cross-sectional side elevational view of a plate cylinder having a printing plate wrapped therearound with a chucking device in accordance with the present invention registering the plate on the cylinder.
Figure 2:
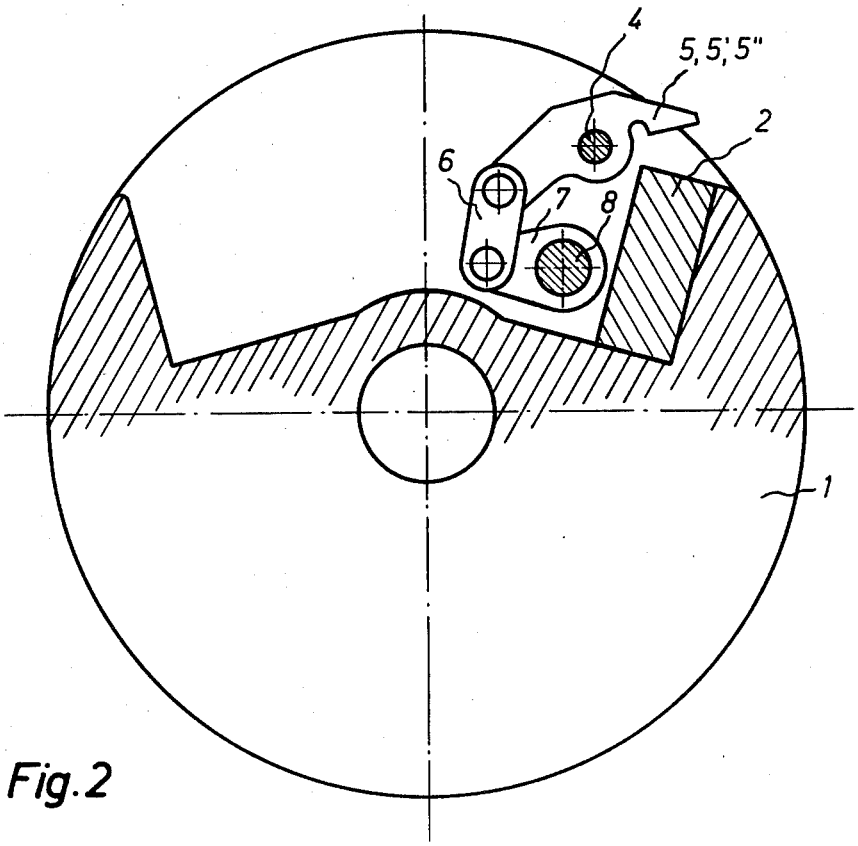
FIG. 2 is a schematic cross-sectional, side elevational view of the chucking device of FIG. 1 with the chuck levers opened.

FIGS. 1 and 2 schematically illustrate an arrangement of a chucking device in accordance with the present invention in the plate cylinder 1 of a printing press. A seating block 2 formed with a generally planar top seating surface is positioned in a corresponding recess of the plate cylinder 1. The top seating or pressure surface of the block 2 blends into the adjacent surfaces of the plate cylinder and serves to accommodate a forward end or lead edge of an offset printing plate 3. A series of chuck levers are arranged in a row longitudinal with the cylinder 1 and mounted for rotation on an axle 4 which is seated in end face surfaces of the plate cylinder. The chuck levers are divided into first and second types having different constructions and capabilities.

Each chuck lever is moved between opened and closed positions, shown in FIG. 2 and FIG. 1, respectively, by means of an articulated lever mechanism comprising two hingedly connected couplers 6 and 7 extending between a pivot shaft 8 and a driven end of the lever. Opposed from the driven end, each lever is formed with a generally planar clamping surface for a generally even engagement with the seating surface of the block 2. The levers chuck the offset plate 3 between their clamping surfaces and the seating or pressure surface of the block 2 as illustrated in FIG. 1. This closure of the chuck levers occurs by means of rotating the shaft 8 on which the coupler link 7 is rigidly keyed. The shaft 8 is rotatably seated in end face surfaces of the plate cylinder 1 and has an actuation means (not shown) beyond the cylinder which may be, for example, a lever or a hand wheel. A detent means may further be utilized to limit rotation of the shaft to a point somewhat beyond the extreme distended positions of the couplers 6 and 7. When the shaft 8 is rotated in the other direction, the chuck levers 5 are driven to their open position as illustrated in FIG. 2.

Figure 3:
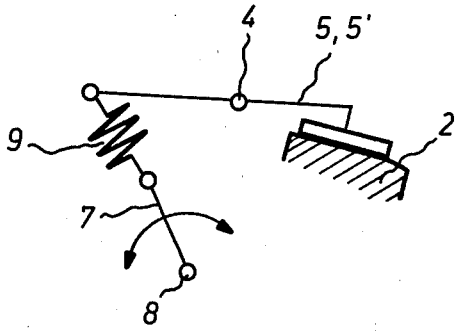
FIG. 3 is a schematic side-elevational view showing an articulated lever mechanism for a first group of chuck levers.
Figure 7:
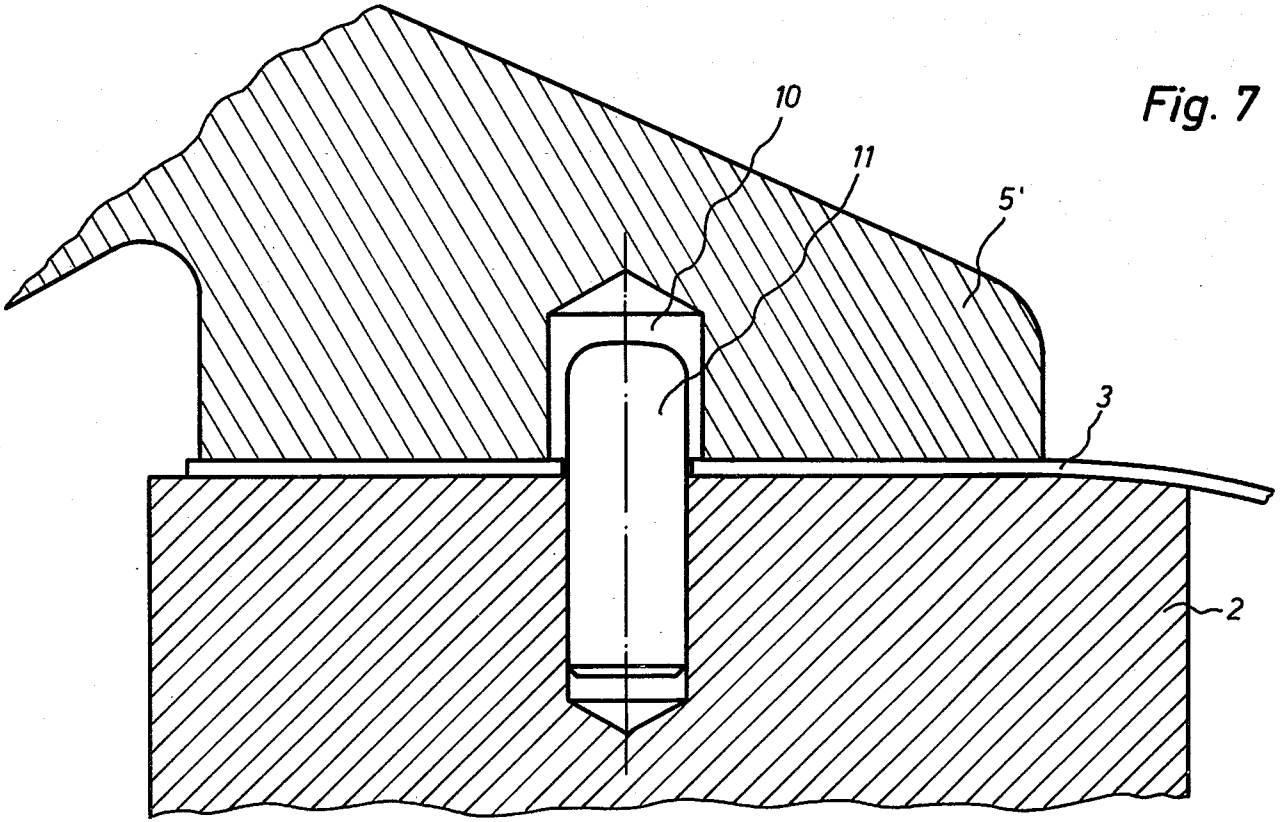
FIG. 7 is a cross-sectional side-elevational view of a chuck lever utilizing register pin means.

The first type of chuck levers 5′ are shown schematically in FIG. 3. For this group of levers, the coupler link 6 is designed as a pressure spring 9, such that these levers resiliently clamp the forward edge of the printing plate against the seating surface of the block 2. Due to the presence of the spring 9, which would be somewhat longer in its relaxed state than the direct line length of the link 6, the chuck levers 5′ seat against the printing plate resiliently and somewhat sooner when the chucking device is actuated. Any number of chuck levers 5′ may be utilized in the chucking device of the present invention. When, for example, two levers 5′ are being used, they are positioned adjacent opposed ends of the lever row for engagement adjacent opposed side surfaces of the printing plate forward edge. Clamping capabilities for the levers 5′ are enhanced by grip means wherein recesses 10 formed in the clamping surfaces as illustrated in FIG. 7. Register pins 11 rigidly or removably disposed on the pressure surface of the block 2 correspondingly engage through the plate 3 and extend into the recesses 10. By virtue of this construction for the first type of chuck levers, the printing plate 3 can be set up with register precision on cylinder 1 before the chucking.

Figure 4:
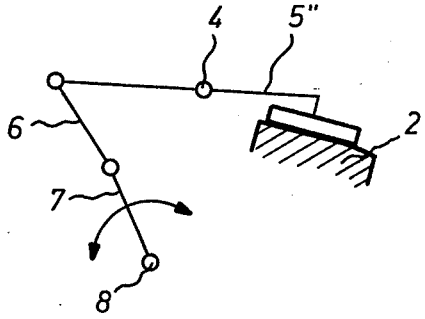
FIG. 4 is a schematic side-elevational view of a non-resilient articulated lever mechanism for a second group of chuck levers.
Figure 5:
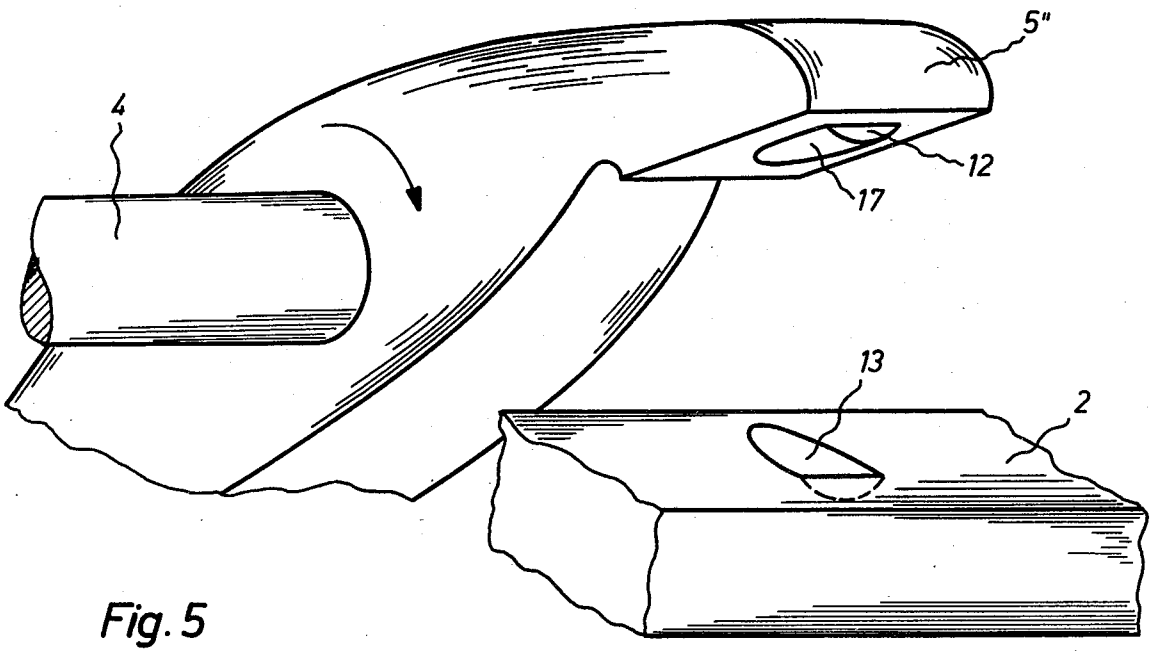
FIG. 5 is a schematic perspective view of a chuck lever having press tool means.
Figure 6:
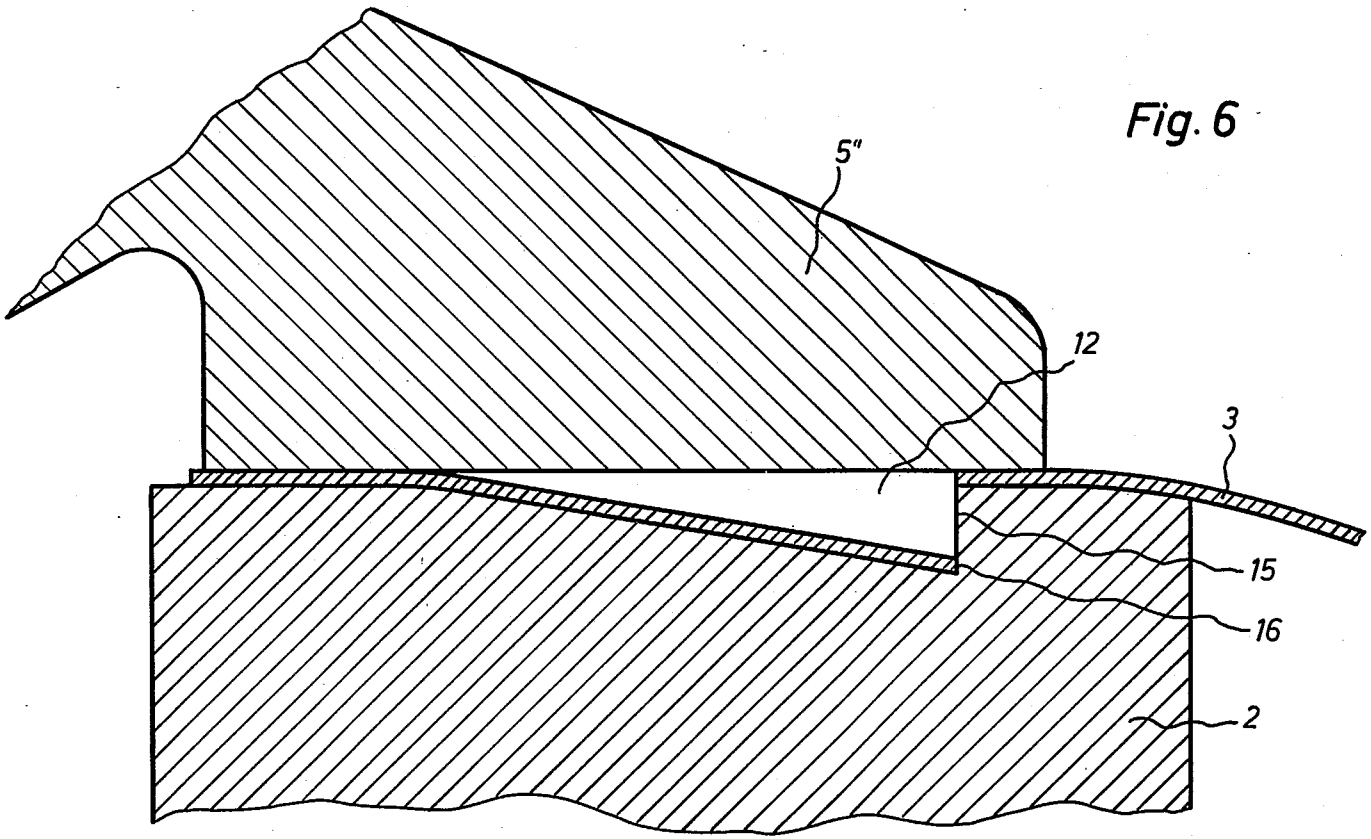
FIG. 6 is a cross-sectional side elevational view of the chuck lever means of FIG. 5 in a closed position.

The second type of chuck lever 5″ is illustrated in FIGS. 4–6. With reference to FIGS. 5–6, grip means are again used. Here in the form of stamping punches which protrude outwardly from the clamping surfaces of the levers for corresponding engagement with troughs or recesses 13 located on the pressure surface of the block 2. A front surface 15 of the stamping punch 12 cuts through the offset plate and, by so doing, forms a support edge 16 which grippingly locks against a generally straight recess sidewall surface of the trough 13 to restrain against forces in the tangential direction. A back portion 17 of the stamping punch is of diminishing protrusion from the clamping surface of the lever so that the offset plate surface which is not cut extends without creasing or folding into the cavity 13. Thus, the supporting edge 16 cannot yield due to deformation against the tension forces.

The levers 5″ are formed with non-resilient articulated links as shown in FIG. 4. These second type of levers come into clamping engagement with the offset printing plate 3 after the first group of levers 5′ have pressed the plate against the pressure surface or set up the plate in the register pins 11, so that the plate can no longer slide or warp. The clamping force of the chuck levers 5″ is prescribed by the geometry of their articulate link designs to be relatively slight so that no deformation of the plate occurs.

The clamping forces alone of the chuck levers, as a whole, is not sufficient to withstand the tangential tension when chucking the plate 3 around the cylinder 1. Tensioning of the offset printing plate 3 around the cylinder 1 is exerted at 14 by a mechanism (not shown) at the back end of the printing plate. For larger printing machines, the tensile force can amount to more than 1,000 kg. Although this force is reduced by frictional resistance due to the wrapping of the plate about the cylinder, it nonetheless still amounts to a couple hundred kg at the clamping surface of the chuck levers 5. If this tension force was being opposed only by means of clamping pressure by the chuck lever clamping surfaces against the pressure surface of the block 2, then the pressing power of the levers would have to be so great that it would come dangerously close to those forces which permanently deform the offset plate 3. Accordingly, the chuck levers, in accordance with the preferred embodiment of the present invention, are formed with grip surface means for locking the forward edge of the plate 3 onto the pressure surface of the block 2.

It is further in contemplation of the present invention that the curvature of the stamping punch 12 and of the recess 13 are illustrated in a somewhat exaggerated manner in the drawings in order to clearly illustrate the manner of functioning. In reality, the rise of the arc of the stamping punch may lie only in the magnitude of a few offset plate thicknesses. When the supporting edge 16 has a certain length in the axial direction of the cylinder, the elastic deformation of that part of the offset plate pressed into the recess 13 is also small.

Tests have shown that tangential forces which lie considerably above those forces generally occurring in a chucking operation as above described can be handled with the described chuck lever arrangement without the register position of the offset printing plate 3 changing with respect to the plate cylinder 1.

Although various minor modifications may be suggested by those versed in the art, it should be understood that I wish to embody within the scope of the patent warranted hereon all such modifications as reasonably and properly come within the scope of my contribution to the art.

I claim as my invention:

1. Apparatus for register-true chucking of a printing plate on a plate cylinder of a printing press comprising:

a seating surface extending longitudinally of said cylinder, said printing plate being wrapped around said cylinder with a leading edge thereof lying across said seating surface, a chuck lever means adjacent said seating surface for holding said leading edge of said printing plate against said seating surface, said chuck lever means comprising a series of chuck levers mounted for rotation about a common pivot shaft extending longitudinally of said cylinder and each respectively driven by associated articulated link means which are all commonly operated by means of a rotatable shaft extending longitudinally of said cylinder, and said plurality of chuck levers comprising both first and second types, said second type including punch-type grip means, the articulated link means associated with said first type each including a resilient element, said resilient element being sized and positioned so as to bias the associated chuck levers into clamping position against the leading edge of the printing plate prior to engagement of said second type chuck levers with said printing plate, the articulated link means associated with said second type chuck levers having only rigid, non-resilient elements.

2. The apparatus of claim 1, wherein both types of said chuck levers are formed with grip means for locking said leading edge of said printing plate against said seating surface.

3. The apparatus of claim 2, wherein said grip means for said second type of chuck lever comprises a punch means formed on a clamping surface of said second type of chuck lever and a recess formed in said seating surface for receiving said punch means therein during clamping operation, such that said punch means deforms said printing plate for extension into said recess.

4. The apparatus of claim 3, wherein said punch means punches through said printing plate on a substantially straight line extending longitudinally of said cylinder such that a stamped edge is formed for positive locking engagement with a corresponding wall surface of said seating surface recess.

5. The apparatus of claim 3, wherein said punch means comprises a thick edge portion from which extends a remaining portion of relatively decreasing thickness such that said thick edge portion serves to punch through said printing plate on a straight line extending longitudinally of said cylinder and said remaining portion deforms said printing plate in a trough-like manner.

6. The apparatus of claim 5, wherein said remaining portion deforms said printing plate without creasing that part of said printing plate extending in said recess.

7. The apparatus of claim 1, wherein said articulated link means for said first type of chuck levers is made resilient by means of a spring member.

8. The apparatus of claim 1, wherein there are two chuck levers of said first type, said two first type chuck levers being arranged adjacent opposed longitudinal ends of said series of chuck levers.

9. The apparatus of claim 1, wherein said chuck levers of said first type have recesses respectively formed in surfaces thereon for pressing against said printing plate, there being corresponding register pins formed on said heating surface for passing through said leading edge of said printing plate and correspondingly extending into said recesses during the clamping operation of said chuck levers.

10. The apparatus of claim 1, said grip means comprising a punch element formed on said chuck lever and a corresponding recess formed in said seating surface for receiving said punch element and stamped-through portion of said printing plate during the clamping operation of said chuck lever means.

* * * * *